US010648054B2

(12) United States Patent
Makimizu et al.

(10) Patent No.: US 10,648,054 B2
(45) Date of Patent: May 12, 2020

(54) METHOD AND FACILITY FOR PRODUCING HIGH-STRENGTH GALAVANIZED STEEL SHEETS

(71) Applicant: JFE STEEL CORPORATION, Tokyo (JP)

(72) Inventors: Yoichi Makimizu, Fukuyama (JP); Yoshitsugu Suzuki, Chiba (JP); Hideyuki Takahashi, Fukuyama (JP); Gentaro Takeda, Fukuyama (JP); Koichiro Fujita, Nagoya (JP)

(73) Assignee: JFE STEEL CORPORATION, Tokyo (JP)

( * ) Notice: Subject to any disclaimer, the term of this patent is extended or adjusted under 35 U.S.C. 154(b) by 409 days.

(21) Appl. No.: 15/509,353

(22) PCT Filed: Aug. 20, 2015

(86) PCT No.: PCT/JP2015/004151
§ 371 (c)(1),
(2) Date: Mar. 7, 2017

(87) PCT Pub. No.: WO2016/038801
PCT Pub. Date: Mar. 17, 2016

(65) Prior Publication Data

US 2017/0253943 A1 Sep. 7, 2017

(30) Foreign Application Priority Data

Sep. 8, 2014 (JP) ..... 2014-182153

(51) Int. Cl.
*C21D 6/00* (2006.01)
*C22C 38/04* (2006.01)
(Continued)

(52) U.S. Cl.
CPC ..... *C21D 9/46* (2013.01); *C21D 8/0226* (2013.01); *C21D 8/0236* (2013.01);
(Continued)

(58) Field of Classification Search
CPC ..... C22C 38/02; C22C 38/04; C21D 6/00; C21D 6/005; C21D 6/008; C21D 1/00; C23C 2/02; C23C 2/04; C23C 2/06
See application file for complete search history.

(56) References Cited

U.S. PATENT DOCUMENTS

2012/0222781 A1 9/2012 Azuma et al.
2013/0071687 A1 3/2013 Takagi et al.
(Continued)

FOREIGN PATENT DOCUMENTS

JP S55-122865 A 9/1980
JP H2-259009 A 10/1990
(Continued)

OTHER PUBLICATIONS

Dec. 6, 2016 Office Action issued in Japanese Patent Application No. 2015-559387.
(Continued)

*Primary Examiner* — Lois L Zheng
(74) *Attorney, Agent, or Firm* — Oliff PLC

(57) ABSTRACT

A method for producing high-strength galvanized steel sheets having excellent coating adhesion, workability and appearance. The method comprises hot rolling a slab comprising, by mass %, C: 0.05 to 0.30%, Si: 0.1 to 2.0% and Mn: 1.0 to 4.0%, then coiling the steel sheet into a coil at a specific temperature $T_C$, and pickling the steel sheet, cold rolling the hot-rolled steel sheet resulting from the hot rolling, annealing the cold-rolled steel sheet resulting from the cold rolling under specific conditions, and galvanizing
(Continued)

the annealed sheet resulting from the annealing in a galvanizing bath containing 0.12 to 0.22 mass % Al.

19 Claims, 3 Drawing Sheets

(51) Int. Cl.

| | |
|---|---|
| ***C22C 38/02*** | (2006.01) |
| ***C21D 9/46*** | (2006.01) |
| ***C23C 2/02*** | (2006.01) |
| ***C23C 2/06*** | (2006.01) |
| ***C23C 2/40*** | (2006.01) |
| ***C23C 2/28*** | (2006.01) |
| ***C22C 38/00*** | (2006.01) |
| ***C21D 8/02*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/18*** | (2006.01) |
| ***C22C 38/32*** | (2006.01) |
| ***C23F 17/00*** | (2006.01) |

(52) U.S. Cl.

CPC ..... *C21D 8/0273* (2013.01); *C21D 8/0278* (2013.01); *C22C 38/00* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/32* (2013.01); *C23C 2/02* (2013.01); *C23C 2/06* (2013.01); *C23C 2/28* (2013.01); *C23C 2/40* (2013.01); *C23F 17/00* (2013.01)

(56) References Cited

U.S. PATENT DOCUMENTS

| | | | | |
|---|---|---|---|---|
| 2014/0220382 | A1* | 8/2014 | Makimizu | C23C 2/02 428/659 |
| 2014/0251505 | A1 | 9/2014 | Blumenau et al. | |
| 2016/0102379 | A1* | 4/2016 | Makimizu | C23C 2/06 148/503 |

FOREIGN PATENT DOCUMENTS

| | | | | |
|---|---|---|---|---|
| JP | H07-34210 | A | 2/1995 | |
| JP | H9-176812 | A | 7/1997 | |
| JP | H 11-279659 | * | 10/1999 | C21D 1/52 |
| JP | H11-279659 | A | 10/1999 | |
| JP | 2007-291498 | A | 11/2007 | |
| JP | 4-202630 | B2 | 12/2008 | |
| JP | 4-202631 | B2 | 12/2008 | |
| JP | 4-202633 | B2 | 12/2008 | |
| JP | 4202632 | B2 | 12/2008 | |
| JP | 4-254531 | B2 | 4/2009 | |
| JP | 4-254532 | B2 | 4/2009 | |
| JP | 2012-12703 | A | 1/2012 | |
| JP | 2014-19935 | A | 2/2014 | |
| WO | 2014/132638 | A1 | 9/2014 | |

OTHER PUBLICATIONS

Nov. 17, 2015 Search Report issued in International Patent Application No. PCT/JP2015/004151.

Mar. 14, 2018 Office Action issued in Korean Patent Application No. 10-2017-7006318.

Nov. 1, 2017 Office Action issued in Chinese Patent Application No. 201580048205.X.

Jun. 27, 2017 Search report issued in European Application No. 15839932.9.

Oct. 1, 2019 Office Action issued in European Patent Application No. 15 839 932.9.

* cited by examiner

METHOD AND FACILITY FOR PRODUCING HIGH-STRENGTH GALAVANIZED STEEL SHEETS

TECHNICAL FIELD

This application relates to a method for producing high-strength galvanized steel sheets excellent in appearance and coating adhesion using Si- and Mn-containing high-strength steel sheets as base steel, and to a production facility for implementing the production method.

BACKGROUND

In recent years, rustproof treatments are performed on the surface of steel sheets for use in such fields as automobiles, home appliances and building materials. In particular, galvanized steel sheets and galvannealed steel sheets that are highly resistant to rust are increasingly used. Further, from the point of view of enhancing the fuel efficiency of automobiles and the safety of automobiles in the event of crash, body materials prefer high-strength steel sheets having higher strength and reduced thickness.

In general, thin steel sheets obtained by the hot rolling or cold rolling of slab are used as the base steel for galvanized steel sheets. The base steel is recrystallized and annealed in an annealing furnace on the CGL (continuous galvanizing line) and is thereafter galvanized. In the case of galvannealed steel sheets, the galvanization is followed by alloying treatment.

The addition of Si and Mn is effective for increasing the strength of steel sheets. However, Si and Mn are oxidized during continuous annealing even in a reductive $N_2$+$H_2$ gas atmosphere which does not cause the oxidation of iron (which reduces iron oxides), forming oxides of Si and Mn on the skin surface of the steel sheets. Such oxides of Si and Mn cause a decrease in the wettability of the base steel sheets with respect to molten zinc during the coating treatment. Consequently, steel sheets containing Si and/or Mn frequently suffer bare spots or, if not bare spots, poor coating adhesion.

Patent Literature 1 discloses a method in which galvanized steel sheets are produced using high-strength steel sheets that contain large amounts of Si and Mn as base steel. In the disclosed method, reducing annealing is performed after an oxide film is formed on the surface of the steel sheets. However, good coating adhesion cannot be obtained stably by the method of Patent Literature 1.

To solve this problem, Patent Literatures 2 to 8 disclose techniques directed to stabilizing the effects by regulating the oxidation rate or the amount of reduction, or by actually measuring the thickness of oxide films formed in the oxidation zone and controlling the oxidation conditions or the reduction conditions based on the measurement results.

In Patent Literature 9, the composition of gases such as $O_2$, $H_2$ and $H_2O$ in the atmosphere during the oxidation-reduction steps is specified.

Patent Literature 10 discloses a production method in which a hot-rolled steel sheet is coiled at an increased temperature so as to form Si and Mn oxides in the crystal grain boundaries of the hot-rolled steel sheet.

CITATION LIST

Patent Literature

[PTL 1:] Japanese Unexamined Patent Application Publication No. 55-122865

[PTL 2:] Japanese Unexamined Patent Application Publication No. 4-202630

[PTL 3:] Japanese Unexamined Patent Application Publication No. 4-202631

[PTL 4:] Japanese Unexamined Patent Application Publication No. 4-202632

[PTL 5:] Japanese Unexamined Patent Application Publication No. 4-202633

[PTL 6:] Japanese Unexamined Patent Application Publication No. 4-254531

[PTL 7:] Japanese Unexamined Patent Application Publication No. 4-254532

[PTL 8:] Japanese Unexamined Patent Application Publication No. 7-34210

[PTL 9:] Japanese Unexamined Patent Application Publication No. 2007-291498

[PTL 10:] Japanese Unexamined Patent Application Publication No. 9-176812

SUMMARY

Technical Problem

It has been found that the methods of producing galvanized steel sheets disclosed in Patent Literatures 2 to 8 cannot always provide sufficient coating adhesion due to oxides of Si and Mn being formed on the surface of steel sheets during continuous annealing.

While the production methods described in Patent Literatures 9 and 10 realize an improvement in coating adhesion, oxide scales formed by excessive oxidation in the oxidation zone are picked up by the rolls in the furnace and become attached thereto to cause the occurrence of dents in the steel sheets. Such a pick-up phenomenon deteriorates appearance.

While the production method described in Patent Literature 9 is effective for improving coating adhesion and preventing a pick-up phenomenon, it has been found that workability enough to withstand press forming cannot be obtained, and the degrees of coating adhesion and of alloying are not uniform and good coating adhesion and appearance cannot be necessarily obtained.

The disclosed embodiments have been made in light of the circumstances discussed above. It is therefore an object of the disclosed embodiments to provide a method for producing high-strength galvanized steel sheets having excellent coating adhesion, workability and appearance, and a production facility which can be used for the implementation of the production method.

Solution to Problem

As mentioned above, the addition of solid solution strengthening elements such as Si and Mn is effective for increasing the strength of steel. Because high-strength steel sheets used in automobile applications are press formed, an enhancement in the balance between strength and ductility is required. In this respect, Si-containing steel is very useful as high-strength steel sheets because Si advantageously increases the strength of steel without causing a decrease in ductility. However, the following problems are encountered in the manufacturing of high-strength galvannealed steel sheets using steel containing Si and Mn as the base steel.

In the annealing atmosphere, Si and Mn form oxides on the skin surface of steel sheets to decrease the wettability of the steel sheets with respect to molten zinc, thereby causing bare spots or, if not bare spots, poor coating adhesion.

In order to prevent the oxidation of Si and Mn on the skin surface of steel sheets and thereby to improve the wettability of the steel sheets with respect to molten zinc, it is effective to cause Si and Mn to form oxides not on the surface of steel sheets but within the steel sheets.

An approach to forming Si and Mn oxides inside a steel sheet is to increase the coiling temperature during hot rolling. This approach, however, comes with a problem that the amount of oxides formed in crystal grain boundaries is not uniform. Specifically, after coiling, the edges and the front and rear ends of a hot-rolled coil are cooled at a higher rate because of the contact of the steel sheet with outside air, and thus the amount of Si and Mn oxides formed is small. On the other hand, the temperature falls at a lower rate in central areas of the coil and consequently Si and Mn oxides are formed in a relatively large amount. As a result, the edges and the front and rear ends of the coil fail to attain sufficient coating adhesion and, in the case of a galvannealed steel sheet, are alloyed nonuniformly to cause poor appearance.

Another approach that is effective for forming Si and Mn oxides inside a steel sheet is to perform oxidation treatment and subsequent reducing annealing as pre-coating treatment. In this approach, the surface of a steel sheet is oxidized in a heating zone on a continuous galvanizing line (CGL) and is thereafter recrystallized and annealed in a reductive atmosphere so that the iron oxide on the steel sheet surface is reduced while Si and Mn are internally oxidized under the steel sheet surface by the oxygen supplied from the iron oxide. This approach is very effective in that Si and Mn internal oxides can be formed relatively uniformly in the coil as compared to the internal oxidation of Si and Mn by hot rolling described hereinabove. It has been thus found that uniform coating adhesion and appearance are effectively attained over the entire length and width of a coil by suppressing internal oxidation that occurs nonuniformly during hot rolling and by positively utilizing the formation of internal oxides by the oxidation-reduction process on the CGL. To make positive use of the formation of internal oxides on the CGL, it is necessary to ensure that a sufficient amount of iron will be oxidized in the heating zone. However, Si contained in steel inhibits the oxidation reaction of iron in the heating zone and therefore the heating of high-Si steel should be performed under conditions that can promote the oxidation reaction particularly in the heating zone. On the other hand, excessive oxidation reaction has been found to lead to surface defects, so-called pick-up phenomenon, in which the iron oxide is detached in the soaking zone downstream of the heating zone and causes the occurrence of dents.

In Si-containing steel, further, the reaction between Fe and Zn in alloying treatment after hot dipping is inhibited. To ensure that alloying will take place normally, the alloying treatment needs to be performed at a relatively high temperature. However, sufficient workability cannot be obtained when the alloying treatment is made at high temperature, perhaps because the retained austenite phase in the steel that is necessary to ensure ductility is decomposed into a perlite phase. Further, it has been found that when the steel is galvanized and alloyed after the steel is cooled to or below Ms point before hot dipping and is thereafter reheated, the martensite phase responsible for strength is tempered and sufficient strength cannot be obtained.

As discussed above, Si-containing steel requires that the alloying temperature be increased, which makes it impossible to obtain desired values of mechanical characteristics.

The present inventors have carried out extensive studies based on the above perspectives, obtaining the following findings.

When a high-strength steel sheet as base steel contains Si and Mn, the oxidation of Si and Mn on the skin surface of the steel sheet causes a decrease in the wettability of the steel sheet with respect to molten zinc. Thus, this oxidation needs to be restrained over the entire length and width of the coil. For this purpose, it is important first to suppress internal oxidation that occurs nonuniformly after hot rolling and second to positively form uniform internal oxides on the CGL.

The above first factor is effectively achieved by lowering the temperature of coiling after rolling, and the upper limit of this temperature is determined in accordance with the contents of Si and Mn in steel.

In order to attain the second factor, the temperature, the atmosphere and the rate of heating in the heating zone are strictly controlled in accordance with the contents of Si and Mn in steel. It has been further found that a pick-up phenomenon ascribed to the excessive oxidation reaction of iron in the heating zone is effectively prevented by rendering the atmosphere in the final stage of the heating zone to have a low oxygen potential. By this approach, the surface of the steel sheet that has been oxidized in the heating zone is reduced and the reduced iron formed on the skin surface effectively prevents a direct contact of iron oxide with rolls in the soaking zone in which a pick-up phenomenon is encountered. The present inventors have found that the above approach controls a pick-up phenomenon and thus prevents the occurrence of surface defects such as dents.

Regarding the high temperature in the alloying treatment of Si-containing steel, an appropriate control of $P_{H2O}/P_{H2}$ during reducing annealing allows the optimum alloying temperature to be decreased and the workability to be enhanced.

The disclosed embodiments are based on the findings described above, and some features of the disclosed embodiments are as described below.

{1} A method for producing high-strength galvanized steel sheets having excellent appearance and coating adhesion, including a hot rolling step of hot rolling a slab including, in mass %, C: 0.05 to 0.30%, Si: 0.1 to 2.0% and Mn: 1.0 to 4.0%, thereafter coiling the steel sheet into a coil at a temperature $T_C$ satisfying the relation (1) below, and pickling the steel sheet, a cold rolling step of cold rolling the hot-rolled steel sheet resulting from the hot rolling step, an annealing step of annealing the cold-rolled steel sheet resulting from the cold rolling step wherein the annealing includes (zone-A heating) to (zone-C heating) described below, and a galvanizing step of galvanizing the annealed sheet resulting from the annealing step in a galvanizing bath containing 0.12 to 0.22 mass % Al.

(Zone-A heating) The cold-rolled steel sheet is heated in a DFF heating furnace (direct-flame furnace) at an air ratio $\alpha$ and an average heating rate at 200° C. and above of 10 to 50° C./sec to a target heating temperature $T_1$ satisfying the relation (2) below.

(Zone-B heating) The cold-rolled steel sheet resulting from the zone-A heating is heated in a DFF heating furnace at an air ratio ≤0.9 and an average heating rate at above $T_1$ of 5 to 30° C./sec to a target heating temperature $T_2$ satisfying the relation (3) below.

(Zone-C heating) The cold-rolled steel sheet resulting from the zone-B heating is heated in an atmosphere containing $H_2$ and $H_2O$, the balance being $N_2$ and inevitable impurities, at a $\log(P_{H2O}/P_{H2})$ of not less than −3.4 and not more than −1.1 and an average heating rate at above $T_2$ of 0.1 to 10° C./sec to a prescribed target heating temperature $T_3$ of 700 to 900° C., and is held at $T_3$ for 10 to 500 seconds.

$$T_C \leq -60([Si]+[Mn])+775 \quad (1)$$

$$T_1 \geq 28.2[Si]+7.95[Mn]-86.2\alpha+666 \quad (2)$$

$$T_2 \geq T_1+30 \quad (3)$$

Here, [Si] and [Mn] are the contents of mass % Si and Mn present in the slab, α is not more than 1.5, and $\log(P_{H2O}/P_{H2})$ is $\log(H_2O$ partial pressure $(P_{H2O})/H_2$ partial pressure $(P_{H2}))$.

{2} The method for producing high-strength galvanized steel sheets having excellent appearance and coating adhesion described in {1}, wherein in the hot-rolled steel sheet obtained in the hot rolling step, the total amount of internal Si oxide and internal Mn oxide found in a subsurface region of the steel sheet at a depth of not more than 10 μm from the steel sheet surface is not more than 0.10 g/m$^2$ per side as expressed in terms of the amount of oxygen in the portion at a central position of the coil of the rolled sheet in the longitudinal direction and in the width direction.

{3} The method for producing high-strength galvanized steel sheets having excellent appearance and coating adhesion described in {1} or {2}, wherein a burner of the DFF heating furnace for the zone-A heating is a nozzle mix burner and a burner of the DFF heating furnace for the zone-B heating is a premix burner.

{4} The method for producing high-strength galvanized steel sheets having excellent appearance and coating adhesion described in any one of {1} to {3}, wherein $\log(P_{H2O}/P_{H2})$ in the zone-C heating satisfies the relation (4) below:

$$0.6[Si]-3.4 \leq \log(P_{H2O}/P_{H2}) \leq 0.8[Si]-2.7 \quad (4)$$

wherein [Si] is the mass % Si content in the steel.

{5} The method for producing high-strength galvanized steel sheets having excellent appearance and coating adhesion described in any one of {1} to {4}, wherein the galvanizing bath contains 0.12 to 0.17 mass % Al and the method further includes an alloying treatment step of alloying the steel sheet resulting from the galvanizing step at an alloying temperature Ta satisfying the relation (5) below for 10 to 60 seconds:

$$-45 \log(P_{H2O}/P_{H2})+395 \leq Ta \leq -30 \log(P_{H2O}/P_{H2})+490 \quad (5).$$

{6} The method for producing high-strength galvanized steel sheets having excellent appearance and coating adhesion described in any one of {1} to {5}, wherein the method further includes a cooling and heating step of cooling the steel sheet after the zone-C heating from 750° C. to a prescribed target cooling temperature $T_4$ of 150 to 350° C. at an average cooling rate of not less than 10° C./sec, thereafter heating the steel sheet to a prescribed reheating temperature $T_5$ of 350 to 600° C., and holding the steel sheet at the temperature $T_5$ for 10 to 600 seconds.

{7} A production facility for manufacturing high-strength galvanized steel sheets having excellent appearance and coating adhesion, the facility being a continuous galvanizing facility including a DFF heating furnace and a soaking furnace, the DFF heating furnace including an upstream nozzle mix burner and a downstream premix burner, the soaking furnace being a radiant tube furnace.

Advantageous Effects

According to the disclosed embodiments, high-strength galvanized steel sheets having excellent appearance and coating adhesion can be obtained.

Further, the disclosed embodiments attain an improvement in the workability of high-strength galvanized steel sheets.

In the disclosed embodiments, the term "high-strength galvanized steel sheets" comprehends both high-strength galvanized steel sheets that are not alloyed, and high-strength galvannealed steel sheets.

DETAILED DESCRIPTION

Figure 1:
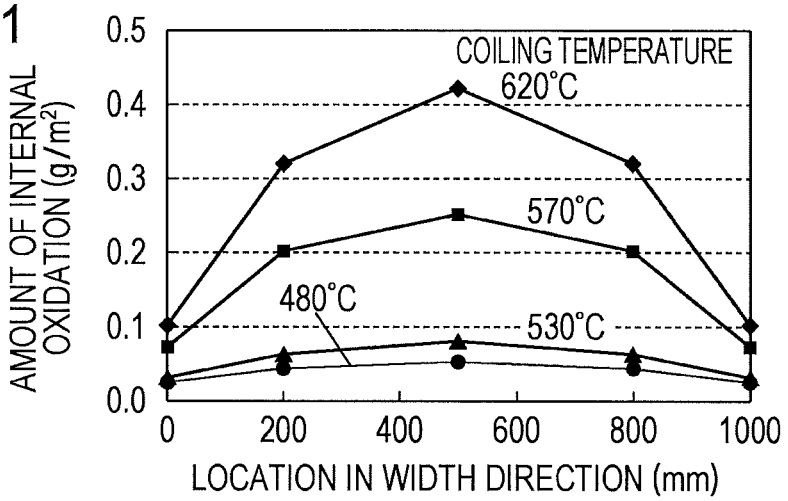
FIG. 1 is a diagram illustrating distributions of the amount of the internal oxidation of Si and Mn in the width direction at varied temperatures of coiling after rolling.

Hereinbelow, embodiments of the disclosed embodiments will be described in detail. The scope of the disclosed embodiments is not limited to those embodiments described below.

A method for producing high-strength galvanized steel sheets of the disclosed embodiments includes a hot rolling step, a cold rolling step, an annealing step and a galvanizing step. Where necessary, the method may further include an alloying treatment step after the galvanizing step. The method may include a cooling and heating step between the annealing step and the galvanizing step. These steps will be described below.

<Hot Rolling Step>

In the hot rolling step, a slab including, in mass %, 0.05 to 0.30% C, 0.1 to 2.0% Si and 1.0 to 4.0% Mn is hot rolled, thereafter coiled into a coil at a temperature $T_C$ satisfying the relation (1) described later, and pickled.

First, the components present in the slab will be described. In the following description, "%" as the unit of the contents of elements contained in the slab is "mass %". The chemical composition of the slab corresponds to the chemical composition of a base steel sheet of a high-strength galvanized steel sheet.

C: 0.05 to 0.30%

If the C content exceeds 0.30%, weldability is deteriorated. Thus, the C content is limited to not more than 0.30%. On the other hand, adding 0.05% or more carbon results in an enhancement in workability by the formation of such a phase as retained austenite phase or martensite phase in the microstructure of the steel.

Si: 0.1 to 2.0%

Si is an element that is effective for obtaining a good quality by strengthening of steel. Economic disadvantages are encountered if the Si content is less than 0.1% because other alloying elements that are expensive are necessary to obtain high strength. In Si-containing steel, the oxidation reaction during oxidation treatment is known to be inhibited. If the Si content exceeds 2.0%, the formation of an oxide film during oxidation treatment is inhibited. Further, adding more than 2.0% Si leads to an increase in alloying temperature and thus makes it difficult to obtain desired mechanical characteristics. Thus, the Si content is limited to not less than 0.1% and not more than 2.0%.

Mn: 1.0 to 4.0%

Mn is an element effective for increasing the strength of steel. To ensure mechanical characteristics and strength, the Mn content is limited to not less than 1.0%. If, on the other hand, the Mn content exceeds 4.0%, it is sometimes difficult to ensure weldability, coating adhesion, and the balance between strength and ductility. Thus, the Mn content is limited to not less than 1.0% and not more than 4.0%.

To control the balance between strength and ductility, the steel may optionally contain one or more elements selected from 0.01 to 0.1% Al, 0.05 to 1.0% Mo, 0.005 to 0.05% Nb, 0.005 to 0.05% Ti, 0.05 to 1.0% Cu, 0.05 to 1.0% Ni, 0.01 to 0.8% Cr and 0.0005 to 0.005% B.

The reasons why the contents of these optional elements are limited to the above appropriate ranges will be described below.

Al: 0.01 to 0.1%

Thermodynamically, aluminum is most prone to oxidation and is oxidized before Si and Mn to suppress the oxidation of Si and Mn on the steel sheet surface and to promote internal oxidation of Si and Mn within the steel sheet. Such effects are obtained by controlling the Al content to 0.01% or above. On the other hand, adding more than 0.1% aluminum increases costs. Thus, when aluminum is added, the Al content is preferably not less than 0.01% and not more than 0.1%.

Mo: 0.05 to 1.0%

Molybdenum controls strength and, when added in combination with Nb, Ni and Cu, improves coating adhesion. These effects are not obtained sufficiently if the Mo content is less than 0.05%. On the other hand, adding more than 1.0% molybdenum increases costs. Thus, when molybdenum is added, the Mo content is preferably not less than 0.05% and not more than 1.0%.

Nb: 0.005 to 0.05%

Niobium controls strength and, when added in combination with Mo, improves coating adhesion. These effects are not obtained sufficiently if the Nb content is less than 0.005%. On the other hand, adding more than 0.05% niobium increases costs. Thus, when niobium is added, the Nb content is preferably not less than 0.005% and not more than 0.05%.

Ti: 0.005 to 0.05%

The effect of titanium in controlling strength is not obtained sufficiently if its content is less than 0.005%. Coating adhesion is decreased if the Ti content is above 0.05%. Thus, when titanium is added, the Ti content is preferably not less than 0.005% and not more than 0.05%.

Cu: 0.05 to 1.0%

Copper promotes the formation of retained γ phase and, when added in combination with Ni and Mo, improves coating adhesion. These effects are not obtained sufficiently if the Cu content is less than 0.05%. On the other hand, adding more than 1.0% copper increases costs. Thus, when copper is added, the Cu content is preferably not less than 0.05% and not more than 1.0%.

Ni: 0.05 to 1.0%

Nickel promotes the formation of retained γ phase and, when added in combination with Cu and Mo, improves coating adhesion. These effects are not obtained sufficiently if the Ni content is less than 0.05%. On the other hand, adding more than 1.0% nickel increases costs. Thus, when nickel is added, the Ni content is preferably not less than 0.05% and not more than 1.0%.

Cr: 0.01 to 0.8%

Hardenability is difficult to attain and the balance between strength and ductility is sometimes deteriorated if the Cr content is less than 0.01%. On the other hand, adding more than 0.8% chromium increases costs. Thus, when chromium is added, the Cr content is preferably not less than 0.01% and not more than 0.8%.

B: 0.0005 to 0.005%

Boron is an element effective for enhancing the hardenability of steel. The hardening effect is difficult to attain if the B content is less than 0.0005%. Because boron has an effect to promote the oxidation of Si on the skin surface of steel sheets, coating adhesion is deteriorated if the B content is above 0.005%. Thus, when boron is added, the B content is preferably not less than 0.0005% and not more than 0.005%.

The balance after the deduction of the essential components and optional components described above is Fe and inevitable impurities. Examples of the inevitable impurities include not more than 0.005% S, not more than 0.06% P and not more than 0.006% N.

Next, the technical significance of the hot rolling step will be described. In usual hot rolling, after steel has been rolled and coiled into a coil, oxygen in oxide scales is diffused to the inside of the steel sheet during the process of cooling. Consequently, Si and Mn are internally oxidized below the surface of the steel sheet. However, as described earlier, the internal oxides of Si and Mn formed after rolling are nonuniform and, when the steel sheet is galvanized on the CGL, cause appearance defects such as uneven coating adhesion and a nonuniform degree of alloying by alloying treatment. Thus, it is important that the formation of internal oxides after hot rolling be suppressed. An effective approach to suppressing the formation of internal Si and Mn oxides is to coil the rolled sheet at a reduced temperature. The coiling temperature needs to be decreased to a greater extent in the case where the steel contains large amounts of oxide-forming Si and Mn.

FIG. 1 shows the results of a study in which rolled sheets of steel containing 1.5% Si and 2.2% Mn were coiled at various temperatures and the distribution of the amount of internal Si and Mn oxides in the width direction was studied with respect to a central area of the coil in the longitudinal direction (a central area of the hot-rolled steel sheet in the longitudinal direction). Here, the amount of internal oxidation was measured by the method described in Examples. As illustrated, the amount of internal oxidation was widely distributed in the width direction when the coiling temperature was high, and the amount of internal oxidation was smaller and more uniform with decreasing coiling temperature.

Figure 2:
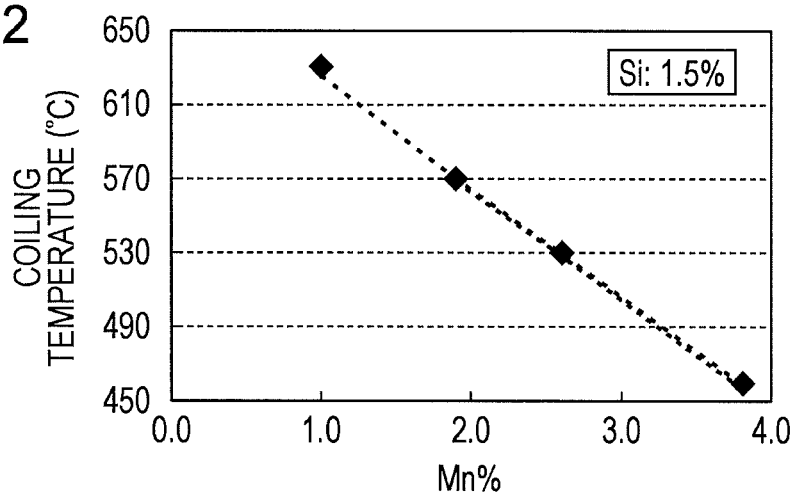
FIG. 2 is a diagram illustrating a relationship between the Mn content and the coiling temperature which causes the amount of internal oxidation to be not more than 0.10 g/m$^2$.
Figure 3:
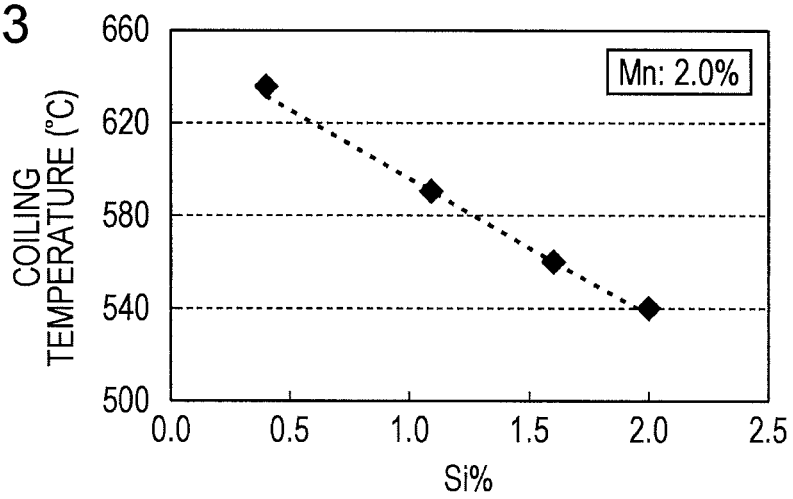
FIG. 3 is a diagram illustrating a relationship between the Si content and the coiling temperature which causes the amount of internal oxidation to be not more than 0.10 g/m$^2$.

A further study has shown that when the amount of internal oxidation in a central area of the coil both in the longitudinal direction and in the width direction is controlled to not more than 0.10 g/m$^2$, the internal oxidation of Si and Mn is rendered more uniform and the steel sheet can be galvanized while reducing the unevenness in coating adhesion and can be alloyed while reducing the unevenness in appearance. (The amount of internal oxidation is defined as the total amount of internal Si oxide and internal Mn oxide found in a subsurface region of the hot-rolled steel sheet at a depth of not more than 10 μm from the steel sheet surface immediately below the scales, and is expressed in terms of the amount of oxygen in the portion at a central position of the coil of the rolled sheet in the longitudinal direction and in the width direction). In the study, steels having various contents of Si and Mn were hot rolled, cooled and coiled, and the amount of internal oxidation was determined with respect to a central area of the coil both in the longitudinal direction and in the width direction. FIGS. 2 and 3 each illustrate a relationship between the Si or Mn content and the coiling temperature which caused the amount of internal oxidation to be not more than 0.10 $g/m^2$. The straight line in each figure represents Tc=−60([Si]+[Mn])+775.

$$Tc \leq -60([Si]+[Mn])+775 \quad \text{Relation (1)}$$

Here, Tc is the temperature of coiling after rolling, and [Si] and [Mn] are the contents of mass % Si and Mn, respectively, in the steel. It is preferable that Tc be 400° C. or above.

As illustrated, the upper limit of the coiling temperature which was necessary to control the amount of internal oxidation to not more than 0.10 $g/m^2$ was lowered with increasing contents of Si and Mn. Further, it has been shown that the amount of internal Si and Mn oxides formed in the central area of the coil after hot rolling may be controlled to not more than 0.10 $g/m^2$ by ensuring that the coiling temperature satisfies the relation (1). That is, the temperature of coiling after hot rolling needs to be set so as to satisfy the relation (1) in order to improve the coating adhesion after hot dipping over the entire length and the entire width, and to improve the appearance uniformity after alloying treatment.

While the temperature of heating before hot rolling and the finishing temperature in hot rolling are not particularly limited, it is desirable from the point of view of microstructure control that the slab be heated to 1100 to 1300° C., soaked, and finish rolled at 800 to 1000° C.

In the disclosed embodiments, rolling under the above conditions is followed by pickling to remove scales. The pickling method is not particularly limited and may be conventional.

<Cold Rolling Step>

In the cold rolling step, the hot-rolled steel sheet resulting from the hot rolling step is cold rolled. The cold rolling conditions are not particularly limited. For example, the hot-rolled steel sheet that has been cooled may be cold rolled with a prescribed rolling reduction of 30 to 80%.

<Annealing Step>

The addition of Si and Mn is effective for realizing high strength and high workability of steel. When, however, steel sheets containing these elements are subjected to an annealing process (oxidation treatment+reducing annealing) prior to galvanization, oxides of Si and Mn are formed on the surface of the steel sheets to make it difficult to ensure coatability. An effective countermeasure to this problem is to cause Si and Mn to be oxidized in the inside of the steel sheets and thereby to prevent the oxidation of these elements on the steel sheet surface. However, as described earlier, internal oxidation occurring after hot rolling has to be suppressed in the disclosed embodiments from the points of view of coating adhesion and uniform alloying. In spite of the amount of internal oxides formed after hot rolling being decreased, strict control of the conditions of annealing (oxidation treatment conditions+reducing annealing conditions) performed prior to galvanization allows Si and Mn to be internally oxidized within the steel sheet, which results in enhanced coatability, and further allows the reactivity between the coating and the steel sheet to be increased and thus the coating adhesion to be improved. In the annealing step, oxidation treatment is performed to ensure that the oxidation of Si and Mn will take place inside the steel sheet and their oxidation on the steel sheet surface will be prevented. In particular, a requirement is that at least a certain amount of iron oxide be formed by the oxidation treatment. Effectiveness may be attained by such treatment and subsequent reducing annealing, hot dipping and optional alloying treatment.

In the annealing step in the disclosed embodiments, the cold-rolled steel sheet resulting from the cold rolling step is subjected to annealing including (zone-A heating), (zone-B heating) and (zone-C heating). First, zone-A heating and zone-B heating corresponding to the oxidation treatment will be described.

Zone-A Heating

In the zone-A heating, the cold-rolled steel sheet is heated in a DFF heating furnace at an air ratio $\alpha$ and an average heating rate at 200° C. and above of 10 to 50° C./sec to a target heating temperature $T_1$ satisfying the relation (2) below. $T_1$ is preferably not more than 750° C.

$$T_1 \geq 28.2[Si]+7.95[Mn]-86.2\alpha+666 \quad (2)$$

Here, $T_1$: target heating temperature ° C. in the zone A, [Si]: mass % Si in the steel, [Mn]: mass % Mn in the steel, and $\alpha$: air ratio in the DFF heating furnace.

The formation of internal oxides of Si and Mn is critical to suppress the oxidation of Si and Mn on the steel sheet surface before hot dipping. In the zone-A heating, iron is positively oxidized to form iron oxide which serves as an oxygen source for the internal oxidation of Si and Mn. Thus, the treatment conditions in the zone-A heating are an important requirement in the disclosed embodiments.

To ensure that a sufficient amount of iron oxide will be formed, heating needs to be performed in a controlled atmosphere and at a controlled temperature. The atmosphere is controlled by manipulating the air ratio in the DFF heating furnace. The DFF heating furnace is a type of a furnace which heats the steel sheet by applying directly to the steel sheet surface a burner flame formed by the combustion of a mixture of a fuel such as coke oven gas (COG) by-produced in a steel plant with air. Increasing the air ratio, that is, increasing the proportion of air to the fuel causes unreacted oxygen to remain in the flame, and this oxygen promotes the oxidation of the steel sheet.

It is necessary that the heating temperature be changed in accordance with the contents of Si and Mn. Si and Mn need to be oxidized inside the steel sheet so that the oxidation of Si and Mn on the steel sheet surface will be suppressed. An increase in the Si and Mn contents also increases the amount of oxygen required for the internal oxidation. Thus, the oxidation needs to take place at a higher temperature with increasing contents of Si and Mn. In particular, Si added to steel is known to inhibit the oxidation reaction of iron. Thus, an increase in Si content necessitates that the oxidation should be performed at a still higher temperature. A study was then made in which the air ratio in the DFF heating furnace and the heating furnace outlet temperature allowing for good coating adhesion were studied with respect to steels containing Si and Mn in various amounts. The results obtained are described in Table 1. Here, the air ratio in the zone-B heating was 0.8, $\log(P_{H2O}/P_{H2})$ in the zone-C heating was −2.7, and the other conditions were in conformity to the requirements set forth in Claim 1. The criteria for the evaluation of coating adhesion were those described in Examples later.

TABLE 1

| Si content | Mn content | Air ratio α | Attained heating temperature $A_1$ (° C.) |
|---|---|---|---|
| 0.2 | 2.3 | 0.93 | 610 |
| 0.5 | 2.5 | 1.05 | 610 |
| 1.0 | 1.3 | 1.10 | 610 |
| 1.0 | 2.0 | 1.10 | 615 |
| 1.5 | 1.9 | 1.15 | 625 |
| 1.5 | 2.6 | 1.15 | 630 |

The unit of the contents is mass %.

By a multiple regression analysis, the influence of the Si content, the Mn content and the air ratio in the DFF heating furnace on the heating furnace outlet temperature (the target heating temperature $T_1$) was analyzed. As a result, the relation (2) below was obtained.

$$T_1 \geq 28.2[\mathrm{Si}]+7.95[\mathrm{Mn}]-86.2\alpha+666 \quad (2)$$

Here, $T_1$: target heating temperature ° C. in the zone A, [Si]: mass % Si in the steel, [Mn]: mass % Mn in the steel, and α: air ratio in the DFF heating furnace.

Figure 4:
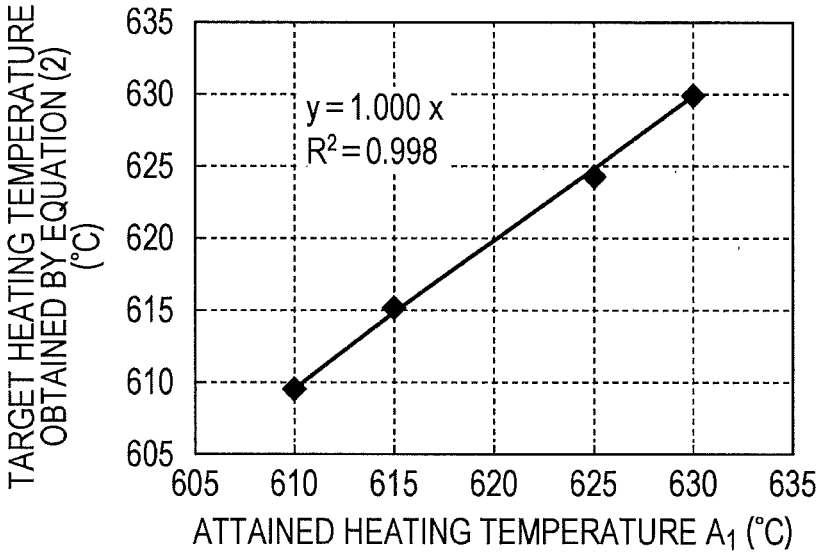
FIG. 4 is a diagram illustrating a relationship between the heating furnace outlet temperature and the target heating temperature obtained using the relation (2).

FIG. 4 compares the heating furnace outlet temperature described in Table 1 with the target heating temperature determined using the relation (2) above (assuming that $T_1$ is $T_1=28.2[\mathrm{Si}]+7.95[\mathrm{Mn}]-86.2\alpha+666$). The correlation coefficient $R^2$ is approximately 1.0, indicating very high correlation. The coefficient for the Si content is very large. This indicates that Si, which not only forms oxide on the steel sheet surface but also has a function to inhibit the oxidation reaction of iron, is a particularly important factor in determining the oxidation conditions. Based on the above discussion, the disclosed embodiments provide that the zone-A heating is performed while satisfying the relation (2). To prevent excessive oxidation reaction of iron and to prevent a consequent pick-up phenomenon, the upper limit of the air ratio α in the zone-A heating is preferably 1.5 or less. At a low air ratio, the atmosphere comes to have weak oxidation power and may fail to ensure a sufficient amount of oxide even when the relation (2) is satisfied. With this in consideration, the air ratio α is preferably not less than 0.9.

In the zone-A heating step, it is necessary that the average heating rate at 200° C. and above be 10 to 50° C./sec. At an average heating rate exceeding 50° C./sec, the time for which the zone-A heating is performed is so short that a sufficient amount of iron oxide cannot be formed. If, on the other hand, the average heating rate is below 10° C./sec, the heating requires too long a time and the production efficiency is deteriorated. Further, such prolonged heating causes excessive formation of iron oxide and the Fe oxide is detached in the reducing atmosphere furnace in the subsequent reducing annealing, resulting in a pick-up phenomenon. From the points of view of the strength and workability of steel, the microstructure is coarsened and stretch-flangeability and bendability are deteriorated if the average heating rate is below 10° C./sec. Thus, the average heating rate at 200° C. and above is limited to 10 to 50° C./sec.

A DFF heating furnace is best suited for the zone-A heating. With a DFF heating furnace, as described earlier, the atmosphere may be rendered oxidizing toward iron by changing the air ratio. Further, a DFF heating furnace heats a steel sheet at a faster rate than radiation heating, and thus the use thereof allows the above average heating rate to be attained.

Of the DFF heating furnaces, a nozzle mix burner is more preferably used for the zone-A heating. A nozzle mix burner can perform heating stably even in the presence of much extra air at a high air ratio, and is thus suited for the zone-A heating step in which iron is to be oxidized. It is preferable that the continuous hot dipping facility used for the implementation of the disclosed embodiments have a DFF heating furnace, and the DFF heating furnace have a nozzle mix burner in an upstream stage.

Zone-B Heating

In the zone-B heating, the cold-rolled steel sheet resulting from the zone-A heating is heated in a DFF heating furnace at an air ratio ≤0.9 and an average heating rate at above $T_1$ of 5 to 30° C./sec to a target heating temperature $T_2$ satisfying the relation (3) below.

$$T_2 \geq T_1+30 \quad (3)$$

Here, $T_2$: target heating temperature (° C.) in the zone B, and $T_1$: target heating temperature (° C.) in the zone A.

The zone-B heating is an important feature in the disclosed embodiments in order to prevent the occurrence of a pick-up phenomenon and to obtain beautiful surface appearance free from defects such as dents. To prevent the occurrence of a pick-up phenomenon, it is important that a portion (a subsurface region) of the steel sheet surface that has been oxidized be reduced. To perform such reduction treatment, it is necessary that the air ratio of the burner in the DFF heating furnace be controlled to not more than 0.9. By lowering the air ratio and decreasing the $O_2$ concentration, the subsurface region of iron oxide is partly reduced and the reduced iron prevents a direct contact of iron oxide with rolls in the furnace in the next reducing annealing step, thereby preventing the occurrence of a pick-up phenomenon. If the air ratio is above 0.9, this reduction reaction is difficult to occur. For this reason, the air ratio is limited to not more than 0.9. The air ratio is preferably 0.7 or above to ensure that combustion in the DFF heating furnace will take place stably.

The heating temperature $T_2$ in the zone B needs to satisfy the relation (3) below:

$$T_2 \geq T_1+30 \quad (3)$$

Here, $T_2$: target heating temperature (° C.) in the zone B, and $T_1$: target heating temperature (° C.) in the zone A.

If the temperature is lower than $T_2$ represented by the relation (3), the reduction reaction is difficult to occur and the effect to prevent the occurrence of a pick-up phenomenon cannot be obtained. To avoid unnecessary heating costs, $T_2$ is preferably not more than 750° C.

In the zone B, it is necessary that the average heating rate (the average rate at which the temperature is increased) at above $T_1$ be 5 to 30° C./sec. At an average heating rate exceeding 30° C./sec, the time for which the zone-B heating is performed is so short that the reduction reaction of iron oxide does not take place to a sufficient extent. If, on the other hand, the average heating rate is below 5° C./sec, the heating requires too long a time and the production efficiency is deteriorated. The phrase "average heating rate at above $T_1$" means the average rate at which the temperature is increased from above $T_1$ to the target heating temperature in the zone B.

A DFF heating furnace is best suited for the zone-B heating. With a DFF heating furnace, as described earlier, a flame that is reductive toward iron may be applied by changing the air ratio. Further, a DFF heating furnace heats a steel sheet at a faster rate than radiation heating, and thus the use thereof allows the above average heating rate to be attained.

Of the DFF heating furnaces, a premix burner is more preferably used for the zone-B heating. A premix burner is suited for the zone-B heating because this burner can produce a flame that is more reductive at high temperatures than is generated by a nozzle mix burner, and is thus advantageous in reducing iron in order to prevent the occurrence of a pick-up phenomenon. It is therefore preferable that the continuous hot dipping facility used for the implementation of the disclosed embodiments have a DFF heating furnace, and the DFF heating furnace have a premix burner in a downstream stage.

Zone-C Heating

In the zone-C heating, the cold-rolled steel sheet resulting from the zone-B heating is heated in an atmosphere containing $H_2$ and $H_2O$, the balance being $N_2$ and inevitable impurities, at a $\log(P_{H2O}/P_{H2})$ of not less than −3.4 and not more than −1.1 and an average heating rate at above $T_2$ of 0.1 to 10° C./sec to a prescribed target heating temperature $T_3$ of 700 to 900° C., and is held at $T_3$ for 10 to 500 seconds.

The zone-C heating is performed immediately after the zone-B heating. During this heating, the iron oxide formed on the steel sheet surface by the zone-A heating is reduced, and the oxygen supplied from the iron oxide forms internal Si and Mn oxides within the steel sheet. As a result, the subsurface region of the steel sheet comes to have a reduced iron layer arising from the reduction of iron oxide, and Si and Mn remain inside the steel sheet as internal oxides so that the oxidation of Si and Mn on the subsurface region of the steel sheet is suppressed. Consequently, the steel sheet is prevented from a decrease in wettability with respect to molten zinc and is thus prevented from suffering bare spots, and good coating adhesion can be obtained. Unlike internal oxides obtained by increasing the temperature of coiling after rolling, the internal oxides formed by the zone-C heating are substantially uniform in the longitudinal direction and in the width direction of the coil, making it possible to prevent unevenness in coating adhesion or appearance.

The atmosphere in the zone-C heating furnace contains $H_2$ and $H_2O$, the balance being $N_2$ and inevitable impurities, and is such that $\log(P_{H2O}/P_{H2})$ is not less than −3.4 and not more than −1.1. Here, $\log(P_{H2O}/P_{H2})$ is $\log(H_2O$ partial pressure $(P_{H2O})/H_2$ partial pressure $(P_{H2}))$. If $\log(P_{H2O}/P_{H2})$ is above −1.1, the iron oxide formed by the zone-A heating is not reduced sufficiently to give rise to a risk that a pick-up phenomenon will occur in the zone-C heating furnace; further, the iron oxide remaining until hot dipping lowers the wettability of the steel sheet with respect to molten zinc, possibly causing poor adhesion or poor appearance. Furthermore, humidification adds costs. If, on the other hand, $\log(P_{H2O}/P_{H2})$ is less than −3.4, the reduction reaction of iron oxide by $H_2$ in the atmosphere is so promoted that oxygen in the iron oxide is reacted with $H_2$ instead of being consumed by internal oxidation, and consequently internal Si and Mn oxides are not formed in sufficient amounts.

In the zone-C heating, the steel sheet is heated at an average heating rate of 0.1 to 10° C./sec from above the target heating temperature $T_2$ in the zone-B heating to a prescribed target heating temperature $T_3$ of 700 to 900° C., and is held at the temperature for 10 to 500 seconds.

If the heating rate exceeds 10° C./sec or the holding time is less than 10 seconds, the time for which the zone-C heating is performed is so short that the reduction reaction of iron oxide does not complete and part of the iron oxide remains without being reduced and possibly causes a decrease in the wettability of the steel sheet with respect to molten zinc and also poor adhesion.

If, on the other hand, the heating rate is less than 0.1° C./sec or the holding time is greater than 500 seconds, the zone-C heating requires too long a time and the productivity is deteriorated or a long CGL is required.

If the holding temperature in the zone-C heating is less than 700° C., the reduction reaction of iron oxide does not take place sufficiently and part of the iron oxide remains without being reduced and possibly causes a decrease in the wettability of the steel sheet with respect to molten zinc and also poor adhesion. Holding at a temperature exceeding 900° C. not only results in a failure to attain desired mechanical characteristics but also gives rise to a risk that the steel strip will rapture in the furnace. It is preferable that holding take place in a soaking furnace in the continuous hot dipping facility, and the soaking furnace be a radiant tube furnace.

For the reasons described above, in the zone-C heating, the steel sheet is heated at an average heating rate of 0.1 to 10° C./sec from the target heating temperature $T_2$ in the zone-B heating to a target heating temperature $T_3$, and is held at the temperature for 10 to 500 seconds.

In the manufacturing of galvannealed steel sheets, the above configurations alone provide good coating adhesion but still entail a high alloying temperature. Consequently, desired mechanical characteristics are not obtained at times due to the decomposition of retained austenite phase to pearlite phase or the temper embrittlement of martensite phase. The present inventors have then studied approaches to decreasing the alloying temperature. As a result, the present inventors have developed a technique which promotes the alloying reaction by forming internal Si oxide more positively and thereby decreasing the amount of solute Si in the subsurface region of the steel sheet. In order to form internal Si oxide more positively, it is effective to control $P_{H2O}/P_{H2}$ in the atmosphere in the zone-C heating furnace more strictly. The oxygen used in the internal oxidation during the zone-C heating is oxygen dissociated from the iron oxide formed by the zone-A heating. Further, the atmosphere in the furnace also serves as an oxygen source. Thus, the higher the $P_{H2O}/P_{H2}$, the higher the oxygen potential in the furnace is and the more the internal oxidation of Si and Mn is facilitated. With Si being internally oxidized, the subsurface region of the steel sheet contains less solute Si. In the presence of less solute Si, the subsurface region of the steel sheet behaves like low-Si steel and the alloying reaction is facilitated and takes place at a lower temperature. With the alloying temperature being lowered, the retained austenite phase can remain in a high fraction and the ductility is enhanced, and the temper embrittlement of martensite phase does not take place and the desired strength is obtained. Here, the subsurface region of the steel sheet indicates a portion extending from the steel sheet surface to a depth of 10 μm.

Figure 5:
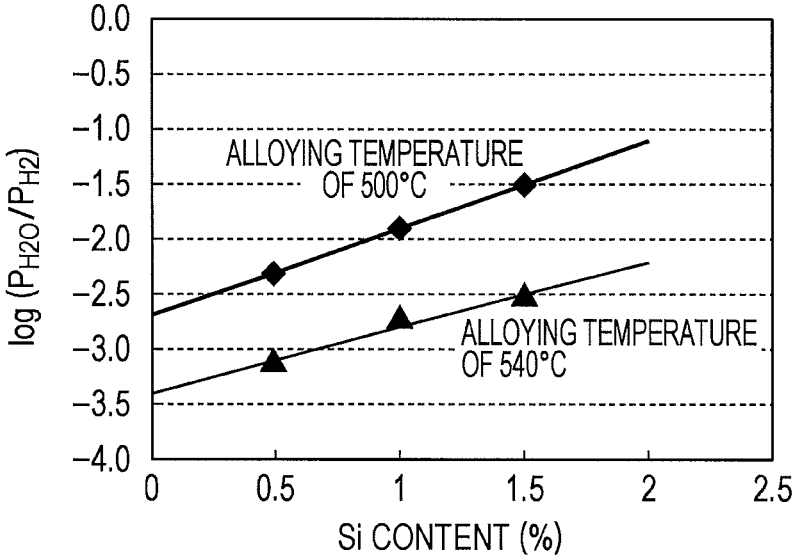
FIG. 5 is a diagram illustrating relationships between the Si content and $\log(P_{H2O}/P_{H2})$ which causes the Fe concentration in a coating to be 10 mass %.

Steel sheets containing 0.13% C, 2.3% Mn and various amounts of Si were heated by zone-A heating and zone-B heating under the aforementioned conditions, and were subjected to zone-C heating at various $P_{H2O}/P_{H2}$ in which the steel sheet was held at 800° C. for 30 seconds. Next, hot dipping was performed, and alloying treatment was made at 520° C. or 540° C. for 25 seconds. The $P_{H2O}/P_{H2}$ which caused the Fe concentration in the coating to be 10 mass % was studied. FIG. 5 illustrates relationships between the Si content in the steel and the logarithm of $P_{H2O}/P_{H2}$ which provided 10 mass % Fe concentration in the coating at each of the temperatures. From FIG. 5, it has been shown that the appropriate alloying temperature is lower as $P_{H2O}/P_{H2}$ is higher and the oxygen potential in the furnace is higher. It has been also shown that because the alloying reaction is inhibited as the Si content is higher, $P_{H2O}/P_{H2}$ needs to be increased to allow the alloying reaction to take place. Further, the relationships between the Si content and $P_{H2O}/$ $P_{H2}$ which causes the Fe concentration in the coating to be 10 mass % at an alloying temperature of 500° C. or 540° C. have been found to be represented by the relations (6) and (7) below, respectively.

[Alloying Temperature of 500° C.]

$$\log(P_{H2O}/P_{H2})=0.8[Si]-2.7 \quad (6)$$

[Alloying Temperature of 540° C.]

$$\log(P_{H2O}/P_{H2})=0.6[Si]-3.4 \quad (7)$$

For the reasons discussed above, a risk that mechanical characteristics may be deteriorated by the decomposition of retained austenite phase or the embrittlement of martensite phase caused by the alloying treatment at high temperature is preferably avoided by controlling $P_{H2O}/P_{H2}$ during the zone-C heating so as to satisfy the relation (4) below:

$$0.8[Si]-2.7 \geq \log(P_{H2O}/P_{H2}) \geq 0.6[Si]-3.4 \quad (4)$$

If $P_{H2O}/P_{H2}$ is larger than the above range, the improvements in mechanical characteristics by the decrease in alloying temperature are saturated, the iron oxide formed by the zone-A heating is not reduced sufficiently to give rise to a risk that a pick-up phenomenon may occur in the reducing annealing furnace, and the iron oxide remaining until hot dipping decreases the wettability of the steel sheet with respect to molten zinc, possibly causing poor adhesion. Further, costs associated with humidification are incurred. If $P_{H2O}/P_{H2}$ is smaller than the above range, no effects are obtained in lowering the alloying temperature and mechanical characteristics are not improved significantly.

The $H_2O$ concentration in the reducing annealing furnace may be controlled by any method without limitation. Example methods are to introduce overheated steam into the furnace, and to introduce $N_2$ and/or $H_2$ gas humidified by bubbling or the like into the furnace. Membrane-exchange humidification using hollow fiber membranes is advantageous in that the controllability of the dew point is enhanced.

The $H_2$ concentration in the zone-C heating furnace is not particularly limited as long as $P_{H2O}/P_{H2}$ is controlled appropriately, but is preferably not less than 5 vol % and not more than 30 vol %. If the concentration is less than 5 vol %, iron oxide is not reduced sufficiently and may cause a pick-up phenomenon. Adding more than 30 vol % hydrogen increases costs. The balance after the deduction of $H_2$ and $H_2O$ is $N_2$ and inevitable impurities.

<Cooling and Heating Step>

In the cooling and heating step, the steel sheet after the zone-C heating is cooled from 750° C. to a prescribed target cooling temperature $T_4$ of 150 to 350° C. at an average cooling rate of not less than 10° C./sec, thereafter heated to a prescribed reheating temperature $T_5$ of 350 to 600° C., and held at the temperature $T_5$ for 10 to 600 seconds. By performing this cooling and heating step, mechanical characteristics may be further enhanced. In the disclosed embodiments, the cooling and heating step is not an essential step, and may be performed as required.

If the rate of cooling from 750° C. is less than 10° C./sec, perlite is formed, and TS×EL and hole expandability are decreased. Thus, the rate of cooling from 750° C. is limited to not less than 10° C./sec.

If the target cooling temperature $T_4$ is higher than 350° C., austenite to martensite transformation is insufficient at the end of cooling and much of the austenite remains untransformed with the result that the final amount of martensite or retained austenite is excessively large and hole expandability is decreased. If the target cooling temperature $T_4$ is below 150° C., substantially all the austenite is transformed into martensite during cooling and little austenite remains untransformed. Thus, the target cooling temperature $T_4$ is limited to the range of 150 to 350° C. The cooling may be performed by any cooling methods such as gas jet cooling, mist cooling, water cooling and metal quenching as long as the desired cooling rate and cooling end temperature (target cooling temperature) can be achieved.

After being cooled to the target cooling temperature $T_4$, the steel sheet is heated to a reheating temperature $T_5$ and is held at the temperature for at least 10 seconds. By this reheating, martensite formed during the cooling is tempered into tempered martensite to provide enhanced hole expandability. Further, the untransformed austenite that has not been transformed into martensite during the cooling is stabilized to ensure a sufficient final amount of retained austenite, and ductility is enhanced as a result.

If the reheating temperature $T_5$ is less than 350° C., the martensite is not tempered sufficiently and the austenite stabilization is insufficient, resulting in poor hole expandability and ductility. If the reheating temperature $T_5$ is above 600° C., the austenite that has not been transformed at the end of cooling is transformed into perlite and it becomes impossible to obtain retained austenite in a final area fraction of 3% or more. Thus, the reheating temperature $T_5$ is limited to 350 to 600° C.

If the holding time is less than 10 seconds, the austenite is not stabilized sufficiently. If the holding time is longer than 600 seconds, the austenite that has not been transformed at the end of cooling is transformed into bainite and the final amount of retained austenite becomes insufficient.

For the reasons described above, the reheating temperature $T_5$ is limited to the range of 350 to 600° C., and the holing time at the temperature is limited to 10 to 600 seconds.

<Galvanizing Step>

In the galvanizing step, the annealed sheet after the annealing step is galvanized in a galvanizing bath containing 0.12 to 0.22 mass % Al.

In the disclosed embodiments, the Al concentration in the zinc coating bath is limited to 0.12 to 0.22 mass %. If the concentration is less than 0.12 mass %, an Fe—Zn alloy phase is formed during the galvanization to cause a decrease in coating adhesion or an uneven appearance at times. If the concentration is higher than 0.22 mass %, an Fe—Al alloy phase is formed thick at the coating/iron interface during the galvanization and the weldability is deteriorated. Further, such excessive aluminum in the bath forms a large amount of an Al oxide film on the surface of the coated steel sheet, and consequently not only weldability but also appearance are deteriorated at times.

When alloying treatment is scheduled to take place, the Al concentration in the galvanizing bath is preferably 0.12 to 0.17 mass %. If the concentration is less than 0.12 mass %, an Fe—Zn alloy phase is formed during the galvanization to cause a decrease in coating adhesion or an uneven appearance at times. If the concentration is higher than 0.17 mass %, an Fe—Al alloy phase is formed thick at the coating/iron interface during the galvanization and serves as a barrier in the Fe—Zn alloying reaction to cause the alloying temperature to be increased and mechanical characteristics to be deteriorated at times.

Other conditions in the hot galvanization are not limited. For example, the steel sheet having a sheet temperature of 440 to 550° C. may be dipped into the galvanizing bath whose temperature is usually in the range of 440 to 500° C., and the coating mass may be controlled by gas wiping or the like.

<Alloying Treatment Step>

In the alloying treatment step, the steel sheet resulting from the galvanizing step is alloyed at a temperature Ta satisfying the relation (5) below for 10 to 60 seconds:

$$-45 \log(P_{H2O}/P_{H2})+395 \leq Ta \leq -30 \log(P_{H2O}/P_{H2})+490 \quad (5)$$

Figure 6:
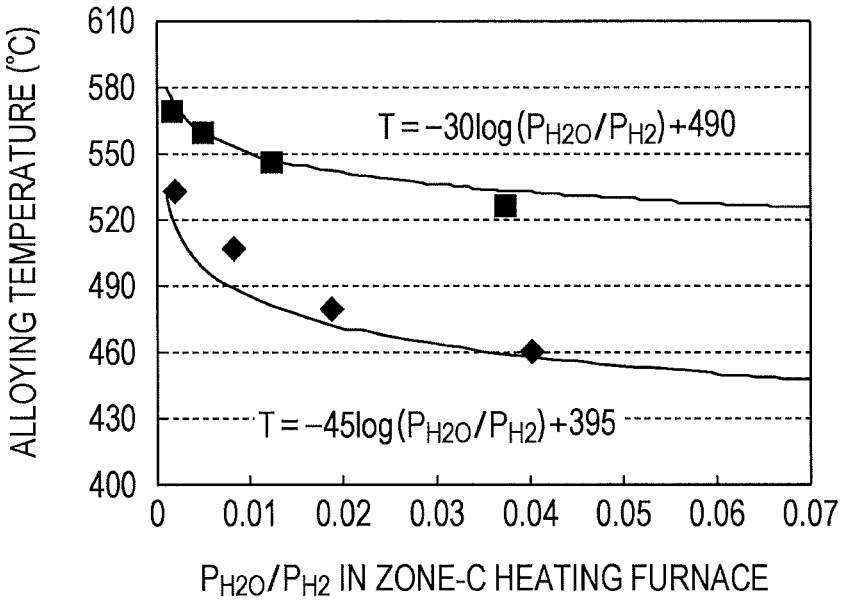
FIG. 6 is a diagram illustrating relationships between $P_{H2O}/P_{H2}$ during zone-C heating and the alloying temperature.

As described earlier, it has been found that positive formation of internal Si oxide by control of $P_{H2O}/P_{H2}$ during the zone-C heating promotes the alloying reaction. A study was then made which looked into the relationship between the change in $P_{H2O}/P_{H2}$ during the zone-C heating and the alloying temperature with respect to galvannealed steel sheets containing 0.13% C, 1.5% Si and 2.6% Mn. The results obtained are illustrated in FIG. 6. In FIG. 6, the black rhombic marks indicate temperatures at which the η phase formed before the alloying was perfectly converted into an Fe—Zn alloy and the alloying reaction had thus completed, and the black squares indicate the upper limit temperatures up to which Rank 3 was obtained when the coating adhesion was evaluated by the method described later in Examples. Further, the lines in the figure show the upper and lower limits of the alloying temperature represented by the relation (5) above.

From FIG. 6, the following findings have been obtained. When the alloying temperature is below (−45 log($P_{H2O}/P_{H2}$)+395)° C., alloying does not proceed completely and the η phase remains. The residual η phase not only appears as unevenness in color tone on the surface and deteriorates the surface appearance, but also increases the frictional coefficient of the surface of the coating to cause a deterioration in press formability. Good coating adhesion cannot be obtained when the alloying temperature exceeds (−30 log ($P_{H2O}/P_{H2}$)+490°) C. Further, as clear from FIG. 6, the alloying temperature that was required decreased with increasing $P_{H2O}/P_{H2}$, which indicates that the Fe—Zn alloying reaction was promoted. Furthermore, as already described earlier, mechanical characteristics are enhanced as $P_{H2O}/P_{H2}$ in the zone-C heating is increased. It has been thus shown that the temperature of alloying after hot dipping needs to be controlled strictly in order to obtain desired mechanical characteristics.

Based on the above discussion, the alloying treatment is to be performed at a temperature Ta satisfying the relation (5) described above.

For similar reasons as the alloying temperature, the alloying time is limited to 10 to 60 seconds.

The degree of alloying (the Fe concentration in the coating) after the alloying treatment is not particularly limited. However, the degree of alloying is preferably 7 to 15 mass %. If the alloying degree is less than 7 mass %, the η phase remains to cause poor press formability. The coating adhesion is decreased if the alloying degree is above 15 mass %.

Examples

Steels were smelted according to the chemical compositions shown in Table 2 and were continuously cast into slabs.

TABLE 2

(Mass %)

| Steel | C | Si | Mn | P | S | Al | Mo | Nb | Ti | Cu | Ni | Cr | B |
|---|---|---|---|---|---|---|---|---|---|---|---|---|---|
| A | 0.08 | 0.25 | 1.5 | 0.03 | 0.001 | — | 0.1 | 0.04 | — | — | — | 0.6 | 0.001 |
| B | 0.11 | 0.8 | 1.9 | 0.01 | 0.001 | 0.05 | — | — | — | — | — | — | — |
| C | 0.08 | 1.0 | 3.5 | 0.01 | 0.001 | — | — | — | — | 0.2 | — | — | — |
| D | 0.12 | 1.4 | 1.9 | 0.01 | 0.001 | — | — | — | — | — | 0.1 | — | — |
| E | 0.09 | 1.5 | 2.5 | 0.01 | 0.001 | — | — | — | 0.02 | — | — | — | 0.001 |
| F | 0.06 | 2.1 | 2.8 | 0.01 | 0.001 | — | — | — | 0.02 | — | — | — | — |
| G | 0.15 | 0.3 | 4.2 | 0.01 | 0.001 | — | — | — | — | — | — | 0.2 | — |
| H | 0.10 | 1.2 | 2.7 | 0.01 | 0.001 | — | — | — | — | — | — | — | — |

The slabs were heated at 1200° C., hot rolled to a sheet thickness of 2.6 mm while controlling the finish temperature to 890° C., coiled into coils at a coiling temperature described in Table 3 (Table 3 consists of Table 3-1 and Table 3-2), cooled, and pickled to remove black scales, thus forming hot-rolled steel sheets. The amount of internal oxidation of Si and/or Mn was measured by the method described later with respect to a central area of the coil both in the longitudinal direction and in the width direction.

Next, the steel sheets were cold rolled to a sheet thickness of 1.2 mm, and the cold-rolled steel sheets were annealed and galvanized on a CGL. Zone-A heating was performed in a DFF heating furnace having a nozzle mix burner under the conditions described in Table 3. Next, zone-B heating was carried out in a DFF heating furnace having a premix burner under the conditions described in Table 3. Zone-C heating involved a radiant-tube heating furnace and the conditions described in Table 3. After the zone-C heating, some of the steel sheets (Nos. 19 and 20) were cooled to a target cooling temperature described in Table 3 at a cooling rate of 20° C./sec, and were thereafter heated to 470° C. and held there for 100 seconds. Subsequently, the steel sheets were galvanized in a 460° C. bath having an Al concentration described in Table 3, and thereafter the basis weight was adjusted to approximately 50 g/m$^2$ by gas wiping. Some of the steel sheets were further subjected to alloying treatment under the temperature and time conditions described in Table 3.

<Amount of Internal Oxidation after Hot Rolling>

The amount of internal oxidation is measured by an "impulse furnace fusion-infrared absorption method". subsurface region on both sides of the hot-rolled steel sheet (central areas of the coil (both in the width direction and in the longitudinal direction)) having a size of 10 mm×70 mm were polished by 10 μm. With respect to each of these portions, the oxygen concentration in the steel was measured before and after the polishing. Based on the difference between the values measured, the amount of oxygen present in the regions 10 μm below the steel sheet surface was expressed as the amount per unit area per side, thereby determining the amount of internal oxidation of Si and/or Mn (g/m$^2$). The internal oxides formed in the subsurface region of the hot-rolled steel sheet were identified as oxides of Si and/or Mn by polishing a cross section of the hot-rolled steel sheet buried in a resin, and analyzing the section by SEM observation and EDS elemental analysis. The amounts of internal oxidation obtained are described in Table 3.

Subsequently, the high-strength galvanized steel sheets obtained by the above process were evaluated in terms of appearance and coating adhesion. The coating adhesion was evaluated with respect to a central area and at 50 mm from an end of the steel strip in the width direction. Further, tensile characteristics were tested. The measurement and evaluation methods are described below.

<Appearance>

The appearance of the steel sheets was visually inspected for defects such as bare spots, dents by picking-up or uneven alloying. The appearance was evaluated as "○" when such defects were absent, "Δ" when the surface had slight defects but was generally acceptable, and "x" when uneven alloying, bare spots or dents were present.

<Coating Adhesion>

The high-strength galvanized steel sheets without alloying treatment were subjected to a ball impact test (a 1000 g bob was dropped from a height of 1 m). A tape was applied to the portion that had received the impact, and was released therefrom. The presence or absence of exfoliation of the coating was visually evaluated based on the following criteria.

○: The coating was not exfoliated.

x: The coating was exfoliated.

CELLOPHANE TAPE (registered trademark) was applied to the high-strength galvanized steel sheets that had been alloyed. The surface covered with the tape was bent 90° and was returned back. A 24 mm wide piece of CELLOPHANE TAPE was pressed against the inner side of the worked part (the side to which a compressive force had been applied) in parallel with the bent part, and was released therefrom. The amount of zinc attached over a 40 mm long portion of CELLOPHANE TAPE was measured in terms of the number of Zn counts by fluorescent X-ray analysis, the result being converted to the number of Zn counts per unit length (1 m) and evaluated based on the following criteria. Those ranked as 1 and 2 were evaluated as excellent (○), those ranked as 3 were evaluated as good (Δ), and those ranked as 4 and above were evaluated as poor (x).

| Number of fluorescent X-ray counts | Ranks |
|---|---|
| 0-less than 500 | 1 (Excellent) |
| 500-less than 1000 | 2 |
| 1000-less than 2000 | 3 |
| 2000-less than 3000 | 4 |
| 3000- | 5 (Poor) |

<Tensile Characteristics>

JIS No. 5 test pieces were tested in accordance with JIS 22241 with respect to the rolling direction as the tensile direction. Tensile characteristics were evaluated as good when TS (MPa)×EL (%) was 15000 (MPa·%) and above.

The results obtained above and the production conditions are described in Table 3.

TABLE 3

| | | After hot rolling | | Zone-A heating | | | Zone-B heating | | | Zone-C heating | | | | |
|---|---|---|---|---|---|---|---|---|---|---|---|---|---|---|
| No. | Steel | Coiling temp. Tc (° C.) | Amount of internal oxidation (g/m$^2$) | Air ratio | Heating rate (° C./sec) | Target temp. $T_1$ (° C.) | Air ratio | Heating rate (° C./sec) | Target temp. $T_2$ (° C.) | log ($P_{H2O}/P_{H2}$) | Heating rate (° C./sec) | Target temp. $T_3$ (° C.) | Holding time (sec) | |
| 1 | E | 510 | 0.07 | 1.2 | 25 | 640 | 0.8 | 20 | 680 | −2.7 | 4 | 810 | 50 | Ex |
| 2 | E | 555 | 0.25 | 1.0 | 25 | 670 | 0.8 | 18 | 705 | −2.7 | 4 | 840 | 60 | Comp. Ex. |
| 3 | E | 510 | 0.06 | 1.0 | 20 | 625 | 0.8 | 18 | 660 | −3.0 | 4 | 810 | 50 | Comp. Ex. |
| 4 | E | 490 | 0.03 | 1.2 | 30 | 650 | 1.1 | 20 | 690 | −2.7 | 2 | 800 | 80 | Comp. Ex. |
| 5 | E | 510 | 0.05 | 1.1 | 40 | 680 | 0.8 | 25 | 720 | −2.7 | 2 | 800 | 50 | Ex |
| 6 | E | 510 | 0.07 | 1.2 | 25 | 640 | 0.8 | 20 | 680 | −2.7 | 4 | 810 | 200 | Ex |
| 7 | E | 480 | 0.02 | 1.2 | 30 | 650 | 0.8 | 20 | 690 | −2.7 | 4 | 800 | 350 | Ex |
| 8 | E | 540 | 0.18 | 1.2 | 25 | 630 | 0.8 | 20 | 660 | −3.0 | 4 | 810 | 50 | Comp. Ex. |
| 9 | E | 510 | 0.06 | 1.0 | 25 | 650 | 0.8 | 20 | 690 | −2.7 | 4 | 810 | 50 | Ex |
| 10 | E | 510 | 0.06 | 1.0 | 20 | 625 | 0.8 | 18 | 660 | −3.0 | 4 | 810 | 50 | Comp. Ex. |
| 11 | E | 510 | 0.06 | 1.0 | 25 | 670 | 0.8 | 18 | 705 | −2.7 | 4 | 840 | 60 | Ex |
| 12 | E | 510 | 0.06 | 1.0 | 25 | 650 | 0.8 | 18 | 700 | −1.0 | 4 | 830 | 50 | Comp. Ex. |
| 13 | E | 510 | 0.06 | 0.9 | 25 | 670 | 0.8 | 18 | 705 | −2.7 | 4 | 840 | 60 | Ex |
| 14 | E | 490 | 0.03 | 1.2 | 30 | 650 | 1.2 | 20 | 690 | −2.7 | 2 | 800 | 80 | Comp. Ex. |
| 15 | E | 490 | 0.03 | 1.2 | 9 | 650 | 0.8 | 4 | 690 | −2.7 | 1 | 780 | 400 | Comp. Ex. |
| 16 | E | 490 | 0.03 | 1.2 | 55 | 700 | 0.8 | 7 | 720 | −2.7 | 2 | 820 | 40 | Comp. Ex. |
| 17 | E | 510 | 0.05 | 1.3 | 40 | 640 | 0.8 | 12 | 680 | −2.1 | 3 | 815 | 100 | Ex |
| 18 | E | 510 | 0.05 | 1.1 | 20 | 660 | 0.7 | 10 | 690 | −1.6 | 2 | 830 | 145 | Ex |
| 19 | E | 490 | 0.04 | 1.2 | 30 | 650 | 0.8 | 15 | 690 | −2.7 | 3 | 800 | 30 | Ex |
| 20 | E | 510 | 0.06 | 1.2 | 30 | 640 | 0.8 | 20 | 680 | −2.7 | 3 | 810 | 60 | Ex |
| 21 | E | 510 | 0.06 | 1.2 | 30 | 640 | 0.8 | 20 | 680 | −2.7 | 3 | 810 | 60 | Ex |
| 22 | E | 510 | 0.06 | 1.2 | 25 | 650 | 0.8 | 25 | 690 | −2.7 | 12 | 890 | 30 | Comp. Ex. |
| 23 | E | 510 | 0.06 | 1.2 | 25 | 650 | 0.8 | 25 | 680 | −2.7 | 4 | 880 | 8 | Comp. Ex. |
| 24 | E | 510 | 0.06 | 1.2 | 25 | 650 | 0.8 | 25 | 680 | −2.7 | 0.5 | 690 | 40 | Comp. Ex. |
| 25 | D | 510 | 0.02 | 1.2 | 25 | 650 | 0.8 | 25 | 700 | −2.7 | 3 | 800 | 45 | Ex |
| 26 | D | 510 | 0.02 | 1.1 | 20 | 630 | 0.7 | 15 | 670 | −2.0 | 3 | 780 | 50 | Ex |
| 27 | D | 550 | 0.07 | 1.2 | 45 | 640 | 0.8 | 35 | 705 | −2.7 | 7 | 820 | 20 | Comp. Ex. |
| 28 | D | 550 | 0.08 | 1.2 | 15 | 620 | 0.8 | 7 | 650 | −2.7 | 0.5 | 790 | 250 | Ex |
| 29 | D | 590 | 0.30 | 1.1 | 20 | 650 | 0.8 | 15 | 690 | −2.7 | 3 | 850 | 45 | Comp. Ex. |
| 30 | D | 510 | 0.03 | 1.2 | 20 | 650 | 1.1 | 15 | 690 | −2.7 | 2 | 830 | 50 | Comp. Ex. |
| 31 | A | 630 | 0.09 | 0.9 | 15 | 620 | 0.8 | 20 | 660 | −2.7 | 4 | 820 | 50 | Ex |
| 32 | A | 510 | 0.01 | 1.1 | 12 | 600 | 0.8 | 20 | 640 | −2.7 | 4 | 820 | 50 | Ex |
| 33 | B | 600 | 0.08 | 1.1 | 15 | 620 | 0.8 | 20 | 660 | −2.7 | 4 | 830 | 40 | Ex |
| 34 | C | 490 | 0.07 | 1.2 | 20 | 630 | 0.8 | 20 | 670 | −2.7 | 3 | 760 | 80 | Ex |

TABLE 3-continued

| | | | | | | | | | | | | | | |
|---|---|---|---|---|---|---|---|---|---|---|---|---|---|---|
| 35 | C | 490 | 0.09 | 1.0 | 30 | 680 | 0.8 | 15 | 720 | −2.7 | 4 | 800 | 60 | Ex |
| 36 | C | 500 | 0.11 | 1.1 | 30 | 650 | 0.8 | 20 | 690 | −2.7 | 4 | 800 | 50 | Ex |
| 37 | C | 520 | 0.12 | 1.1 | 25 | 640 | 0.9 | 20 | 680 | −2.7 | 4 | 810 | 50 | Comp. Ex. |
| 38 | F | 480 | 0.11 | 1.2 | 30 | 650 | 0.8 | 15 | 690 | −2.7 | 3 | 790 | 60 | Comp. Ex. |
| 39 | F | 460 | 0.08 | 1.2 | 30 | 650 | 0.8 | 15 | 690 | −2.7 | 5 | 780 | 90 | Comp. Ex. |
| 40 | G | 490 | 0.07 | 1.2 | 30 | 620 | 0.8 | 15 | 690 | −2.7 | 4 | 800 | 50 | Comp. Ex. |
| 41 | H | 510 | 0.05 | 1.2 | 30 | 640 | 0.8 | 20 | 680 | −2.7 | 3 | 810 | 50 | Ex |

| | | Cooling after zone-C heating | Hot galvanizing | Alloying treatment | | | | | | | |
|---|---|---|---|---|---|---|---|---|---|---|---|
| No. | Steel | Cooling finish temp. (° C.) | Al concentration in bath (%) | Alloying temp. Ta (° C.) | Alloying time (sec) | Coating appearance | Coating adhesion Center | Coating adhesion End | TS (MPa) | EL (%) | |
| 1 | E | — | 0.13 | — | — | ○ | ○ | ○ | 1022 | 19.3 | Ex |
| 2 | E | — | 0.13 | — | — | ○ | ○ | x | 1013 | 19.2 | Comp. Ex. |
| 3 | E | — | 0.13 | — | — | Δ | ○ | ○ | 1005 | 19.9 | Comp. Ex. |
| 4 | E | — | 0.13 | — | — | x | ○ | ○ | 1015 | 18.9 | Comp. Ex. |
| 5 | E | — | 0.20 | — | — | ○ | ○ | ○ | 1031 | 19.0 | Ex |
| 6 | E | — | 0.13 | 545 | 25 | ○ | ○ | ○ | 1037 | 15.6 | Ex |
| 7 | E | — | 0.13 | 530 | 25 | ○ | ○ | ○ | 1022 | 16.2 | Ex |
| 8 | E | — | 0.13 | 540 | 25 | x | ○ | x | 1004 | 16.0 | Comp. Ex. |
| 9 | E | — | 0.13 | 540 | 25 | ○ | ○ | ○ | 997 | 17.0 | Ex |
| 10 | E | — | 0.13 | 545 | 25 | x | x | x | 1015 | 15.9 | Comp. Ex. |
| 11 | E | — | 0.13 | 530 | 25 | ○ | ○ | ○ | 1025 | 15.7 | Ex |
| 12 | E | — | 0.13 | 470 | 25 | Δ | ○ | ○ | 1055 | 17.2 | Comp. Ex. |
| 13 | E | — | 0.15 | 560 | 30 | ○ | ○ | ○ | 995 | 16.4 | Ex |
| 14 | E | — | 0.13 | 530 | 40 | x | ○ | ○ | 1001 | 16.9 | Comp. Ex. |
| 15 | E | — | 0.13 | 520 | 55 | x | ○ | ○ | 994 | 16.0 | Comp. Ex. |
| 16 | E | — | 0.13 | 520 | 25 | x | x | x | 1021 | 15.7 | Comp. Ex. |
| 17 | E | — | 0.13 | 505 | 20 | ○ | ○ | ○ | 1001 | 17.1 | Ex |
| 18 | E | — | 0.13 | 480 | 25 | ○ | ○ | ○ | 1020 | 18.2 | Ex |
| 19 | E | — | 0.19 | 565 | 50 | ○ | ○ | ○ | 981 | 14.5 | Ex |
| 20 | E | 300 | 0.13 | 540 | 25 | ○ | ○ | ○ | 912 | 20.4 | Ex |
| 21 | E | 200 | 0.13 | 540 | 25 | ○ | ○ | ○ | 825 | 23.5 | Ex |
| 22 | E | — | 0.13 | 540 | 25 | ○ | x | x | 986 | 18.0 | Comp. Ex. |
| 23 | E | — | 0.13 | 540 | 25 | ○ | x | x | 1021 | 15.5 | Comp. Ex. |
| 24 | E | — | 0.13 | 540 | 25 | ○ | x | x | 965 | 16.0 | Comp. Ex. |
| 25 | D | — | 0.13 | 540 | 30 | ○ | ○ | ○ | 804 | 20.4 | Ex |
| 26 | D | — | 0.13 | 510 | 20 | ○ | ○ | ○ | 815 | 22.4 | Ex |
| 27 | D | — | 0.13 | 530 | 15 | x | ○ | ○ | 792 | 20.5 | Comp. Ex. |
| 28 | D | — | 0.13 | 540 | 50 | ○ | ○ | ○ | 822 | 19.7 | Ex |
| 29 | D | — | 0.14 | 560 | 40 | ○ | ○ | x | 804 | 19.0 | Comp. Ex. |
| 30 | D | — | 0.13 | 540 | 30 | x | ○ | ○ | 797 | 20.9 | Comp. Ex. |
| 31 | A | — | 0.13 | 520 | 25 | ○ | ○ | ○ | 615 | 24.5 | Ex |
| 32 | A | — | 0.13 | 520 | 30 | ○ | ○ | ○ | 605 | 25.3 | Ex |
| 33 | B | — | 0.13 | 540 | 25 | ○ | ○ | ○ | 835 | 19.5 | Ex |
| 34 | C | — | 0.13 | 540 | 25 | ○ | ○ | ○ | 1033 | 15.6 | Ex |
| 35 | C | — | 0.13 | 540 | 30 | ○ | ○ | ○ | 1011 | 16.4 | Ex |
| 36 | C | — | 0.13 | 540 | 30 | ○ | ○ | ○ | 1008 | 15.4 | Ex |
| 37 | C | — | 0.13 | 550 | 30 | ○ | ○ | x | 1006 | 16.0 | Comp. Ex. |
| 38 | F | — | 0.13 | 550 | 40 | x | ○ | x | 1054 | 16.9 | Comp. Ex. |
| 39 | F | — | 0.13 | 550 | 40 | x | ○ | ○ | 1067 | 16.3 | Comp. Ex. |
| 40 | G | — | 0.13 | 520 | 30 | x | ○ | ○ | 1201 | 14.1 | Comp. Ex. |
| 41 | H | — | 0.13 | 540 | 30 | ○ | ○ | ○ | 1019 | 16.4 | Ex |

From Table 3, the high-strength galvanized steel sheets of Examples according to the disclosed embodiments attained excellent coating adhesion and good coating appearance in spite of their containing Si and Mn, and were also excellent in ductility. In contrast, the steel sheets of Comparative Examples manufactured under conditions outside the range of disclosed embodiments were poor in either or both of coating adhesion and coating appearance.

INDUSTRIAL APPLICABILITY

The high-strength galvanized steel sheets obtained by the manufacturing method of the disclosed embodiments are excellent in appearance and coating adhesion, and may be used as surface-treated steel sheets to make automobile bodies themselves more lightweight and stronger.

The invention claimed is:

1. A method for producing high-strength galvanized steel sheets, the method comprising:

hot rolling a slab comprising, by mass %, C: 0.05 to 0.30%, Si: 0.1 to 2.0% and Mn: 1.0 to 4.0%, into a steel sheet, then coiling the steel sheet into a coil at a temperature Tc satisfying the relationship (1), and pickling the steel sheet;

cold rolling the hot-rolled steel sheet resulting from the hot rolling;

annealing the cold-rolled steel sheet resulting from the cold rolling, the annealing including (zone-A heating), (zone-B heating), and (zone-C heating); and galvanizing the annealed sheet resulting from the annealing in a galvanizing bath comprising 0.12 to 0.22 mass % Al, wherein:

(zone-A heating): the cold-rolled steel sheet is heated in a direct-flame furnace at an air ratio α and an average heating rate at 200° C. and above is in a range of 10 to 50° C./sec to a target heating temperature $T_1$ (° C.) satisfying the relationship (2), (zone-B heating): the cold-rolled steel sheet resulting from the zone-A heating is heated in a direct-flame furnace at an air ratio ≤0.9 and an average heating rate at above $T_1$ is in a range of 5 to 30° C./sec to a target heating temperature $T_2$ (OC) satisfying the relationship (3), and (zone-C heating): the cold-rolled steel sheet resulting from the zone-B heating is heated in an atmosphere containing $H_2$ and $H_2O$, the balance being $N_2$ and inevitable impurities, at a $\log(P_{H2O}/P_{H2})$ in a range of not less than −3.4 and not more than −1.1 and an average heating rate at above $T_2$ is in a range of 0.1 to 10° C./sec to a prescribed target heating temperature $T_3$ (° C.) in a range of 700 to 900° C., and is held at $T_3$ for 10 to 500 seconds, $$T_C \leq -60([Si]+[Mn])+775 \quad (1)$$

$$T_1 \geq 28.2[Si]+7.95[Mn]-86.2\alpha+666 \quad (2)$$

$$T_2 \geq T_1+30 \quad (3)$$

wherein [Si] and [Mn] are the contents of mass % Si and Mn present in the slab, α is not more than 1.5, and $\log(P_{H2O}/P_{H2})$ is $\log(H_2O$ partial pressure $(P_{H2O})/H_2$ partial pressure $(P_{H2}))$.

2. The method for producing high-strength galvanized steel sheets according to claim 1, wherein in the hot-rolled steel sheet obtained in the hot rolling, the total amount of internal Si oxide and internal Mn oxide found in a subsurface region of the steel sheet at a depth of not more than 10 μm from the steel sheet surface is not more than 0.10 g/m$^2$ per side as expressed in terms of an amount of oxygen in a portion at a central position of the coil of the hot-rolled steel sheet in the longitudinal direction and in the width direction.

3. The method for producing high-strength galvanized steel sheets according to claim 1, wherein a burner of the direct-flame furnace for the zone-A heating is a nozzle mix burner, and a burner of the direct-flame furnace for the zone-B heating is a premix burner.

4. The method for producing high-strength galvanized steel sheets according to claim 1, wherein $\log(P_{H2O}/P_{H2})$ in the zone-C heating satisfies the relationship (4), $$0.6[Si]-3.4 \leq \log(P_{H2O}/P_{H2}) \leq 0.8[Si]-2.7 \quad (4)$$

wherein [Si] is the mass % Si content in the steel.

5. The method for producing high-strength galvanized steel sheets according to claim 1, further comprising alloying the steel sheet resulting from the galvanizing at an alloying temperature Ta satisfying the relationship (5) for 10 to 60 seconds, $$-45 \log(P_{H2O}/P_{H2})+395 \leq Ta \leq -30 \log(P_{H2O}/P_{H2})+490 \quad (5)$$

wherein the galvanizing bath includes 0.12 to 0.17 mass % Al.

6. The method for producing high-strength galvanized steel sheets according to claim 1, further comprising cooling the steel sheet after the zone-C heating from 750° C. to a prescribed target cooling temperature $T_4$ (° C.) in a range of 150 to 350° C. at an average cooling rate of not less than 10° C./sec, thereafter heating the steel sheet to a prescribed reheating temperature $T_5$ (° C.) in a range of 350 to 600° C., and holding the steel sheet at the temperature $T_5$ for 10 to 600 seconds.

7. The method for producing high-strength galvanized steel sheets according to claim 2, wherein a burner of the direct-flame furnace for the zone-A heating is a nozzle mix burner, and a burner of the direct-flame furnace for the zone-B heating is a premix burner.

8. The method for producing high-strength galvanized steel sheets having excellent appearance and coating adhesion according to claim 2, wherein $\log(P_{H2O}/P_{H2})$ in the zone-C heating satisfies the relationship (4), $$0.6[Si]-3.4 \leq \log(P_{H2O}/P_{H2}) \leq 0.8[Si]-2.7 \quad (4)$$

wherein [Si] is the mass % Si content in the steel.

9. The method for producing high-strength galvanized steel sheets having excellent appearance and coating adhesion according to claim 3, wherein $\log(P_{H2O}/P_{H2})$ in the zone-C heating satisfies the relationship (4), $$0.6[Si]-3.4 \leq \log(P_{H2O}/P_{H2}) \leq 0.8[Si]-2.7 \quad (4)$$

wherein [Si] is the mass % Si content in the steel.

10. The method for producing high-strength galvanized steel sheets having excellent appearance and coating adhesion according to claim 7, wherein $\log(P_{H2O}/P_{H2})$ in the zone-C heating satisfies the relationship (4), $$0.6[Si]-3.4 \leq \log(P_{H2O}/P_{H2}) \leq 0.8[Si]-2.7 \quad (4)$$

wherein [Si] is the mass % Si content in the steel.

11. The method for producing high-strength galvanized steel sheets according to claim 2, further comprising alloying the steel sheet resulting from the galvanizing at an alloying temperature Ta satisfying the relationship (5) for 10 to 60 seconds, $$-45 \log(P_{H2O}/P_{H2})+395 \leq Ta \leq -30 \log(P_{H2O}/P_{H2})+490 \quad (5)$$

wherein the galvanizing bath includes 0.12 to 0.17 mass % Al.

12. The method for producing high-strength galvanized steel sheets according to claim 3, further comprising alloying the steel sheet resulting from the galvanizing at an alloying temperature Ta satisfying the relationship (5) for 10 to 60 seconds, $$-45 \log(P_{H2O}/P_{H2})+395 \leq Ta \leq -30 \log(P_{H2O}/P_{H2})+490 \quad (5)$$

wherein the galvanizing bath includes 0.12 to 0.17 mass % Al.

13. The method for producing high-strength galvanized steel sheets according to claim 4, further comprising alloying the steel sheet resulting from the galvanizing at an alloying temperature Ta satisfying the relationship (5) for 10 to 60 seconds, $$-45 \log(P_{H2O}/P_{H2})+395 \leq Ta \leq -30 \log(P_{H2O}/P_{H2})+490 \quad (5)$$

wherein the galvanizing bath includes 0.12 to 0.17 mass % Al.

14. The method for producing high-strength galvanized steel sheets according to claim 7, further comprising alloying the steel sheet resulting from the galvanizing at an alloying temperature Ta satisfying the relationship (5) for 10 to 60 seconds, $$-45 \log(P_{H2O}/P_{H2})+395 \leq Ta \leq -30 \log(P_{H2O}/P_{H2})+490 \quad (5)$$

wherein the galvanizing bath includes 0.12 to 0.17 mass % Al.

15. The method for producing high-strength galvanized steel sheets according to claim 8, further comprising alloying the steel sheet resulting from the galvanizing at an alloying temperature Ta satisfying the relationship (5) for 10 to 60 seconds, $$-45 \log(P_{H2O}/P_{H2})+395 \leq Ta \leq -30 \log(P_{H2O}/P_{H2})+490 \quad (5)$$

wherein the galvanizing bath includes 0.12 to 0.17 mass % Al.

16. The method for producing high-strength galvanized steel sheets according to claim 9, further comprising alloying the steel sheet resulting from the galvanizing at an alloying temperature Ta satisfying the relationship (5) for 10 to 60 seconds, $$-45 \log(P_{H2O}/P_{H2})+395 \leq Ta \leq -30 \log(P_{H2O}/P_{H2})+490 \quad (5)$$

wherein the galvanizing bath includes 0.12 to 0.17 mass % Al.

17. The method for producing high-strength galvanized steel sheets according to claim 10, further comprising alloying the steel sheet resulting from the galvanizing at an alloying temperature Ta satisfying the relationship (5) for 10 to 60 seconds, $$-45 \log(P_{H2O}/P_{H2})+395 \leq Ta \leq -30 \log(P_{H2O}/P_{H2})+490 \quad (5)$$

wherein the galvanizing bath includes 0.12 to 0.17 mass % Al.

18. The method for producing high-strength galvanized steel sheets according to claim 2, further comprising cooling the steel sheet after the zone-C heating from 750° C. to a prescribed target cooling temperature $T_4$ (° C.) in a range of 150 to 350° C. at an average cooling rate of not less than 10° C./sec, thereafter heating the steel sheet to a prescribed reheating temperature $T_5$ (° C.) in a range of 350 to 600° C., and holding the steel sheet at the temperature $T_5$ for 10 to 600 seconds.

19. The method for producing high-strength galvanized steel sheets according to claim 3, further comprising cooling the steel sheet after the zone-C heating from 750° C. to a prescribed target cooling temperature $T_4$ (° C.) in a range of 150 to 350° C. at an average cooling rate of not less than 10° C./sec, thereafter heating the steel sheet to a prescribed reheating temperature $T_5$ (° C.) in a range of 350 to 600° C., and holding the steel sheet at the temperature $T_5$ for 10 to 600 seconds.

* * * * *